US005274954A

United States Patent [19]

Quarfordt et al.

[11] Patent Number: 5,274,954

[45] Date of Patent: Jan. 4, 1994

[54] DISHWASHER DOOR CONTROL SYSTEM

[75] Inventors: Carl Quarfordt, Huskvarna; Lars-Bertil Ohlson, Jönköping, both of Sweden

[73] Assignee: Aktiebolaget Electrolux, Sweden

[21] Appl. No.: 956,424

[22] Filed: Sep. 30, 1992

Related U.S. Application Data

[63] Continuation of Ser. No. 750,096, Aug. 26, 1991, abandoned.

[30] Foreign Application Priority Data

Sep. 25, 1990 [SE] Sweden ..... 9003030

[51] Int. Cl.[5] ..... E05F 1/10

[52] U.S. Cl. ..... 49/386; 16/306; 267/182

[58] Field of Search ..... 49/386, 387, 381; 16/51, 65, 306; 267/182, 209, 211, 221, 224, 225

[56] References Cited

U.S. PATENT DOCUMENTS

| | | | |
|---|---|---|---|
| 4,350,382 | 9/1982 | Spronck | 49/386 X |
| 4,359,119 | 11/1982 | Kammerman | 49/386 X |
| 4,665,892 | 5/1987 | Spargo et al. | 49/386 X |
| 4,718,532 | 1/1988 | Chalabian | 49/386 X |
| 4,817,240 | 4/1989 | Sovis, Jr. et al. | 16/306 X |
| 4,828,236 | 5/1989 | Inoue | 49/386 X |
| 4,844,567 | 7/1989 | Chalabian | 49/386 X |
| 4,949,573 | 8/1990 | Wolfe et al. | 188/299 X |
| 4,966,403 | 10/1990 | Nordström | 49/386 X |
| 4,991,675 | 2/1991 | Tosconi et al. | 49/386 X |
| 5,087,022 | 2/1992 | Rieck et al. | 267/221 X |

FOREIGN PATENT DOCUMENTS

| | | | |
|---|---|---|---|
| 2235723 | 3/1991 | United Kingdom | 49/386 |

*Primary Examiner*—Peter M. Cuomo
*Assistant Examiner*—Jerry Redman
*Attorney, Agent, or Firm*—Pearne, Gordon, McCoy & Granger

[57] ABSTRACT

A door control system for dishwashers having doors mounted for pivotal movement between a vertical closed position and a horizontal open position. Pivot brackets are provided on each side of the door to support the door for such pivotal movement. A counterbalancing spring is connected to the bracket to produce a resilient force urging the door toward the closed position. A damper is also connected to the bracket to control the rate of movement of the door so that the door slowly and gently approaches the open position. The system functions effectively without adjustment of the spring even when the weight of the door is changed by the addition of decorative panels to the outside of the door.

9 Claims, 1 Drawing Sheet

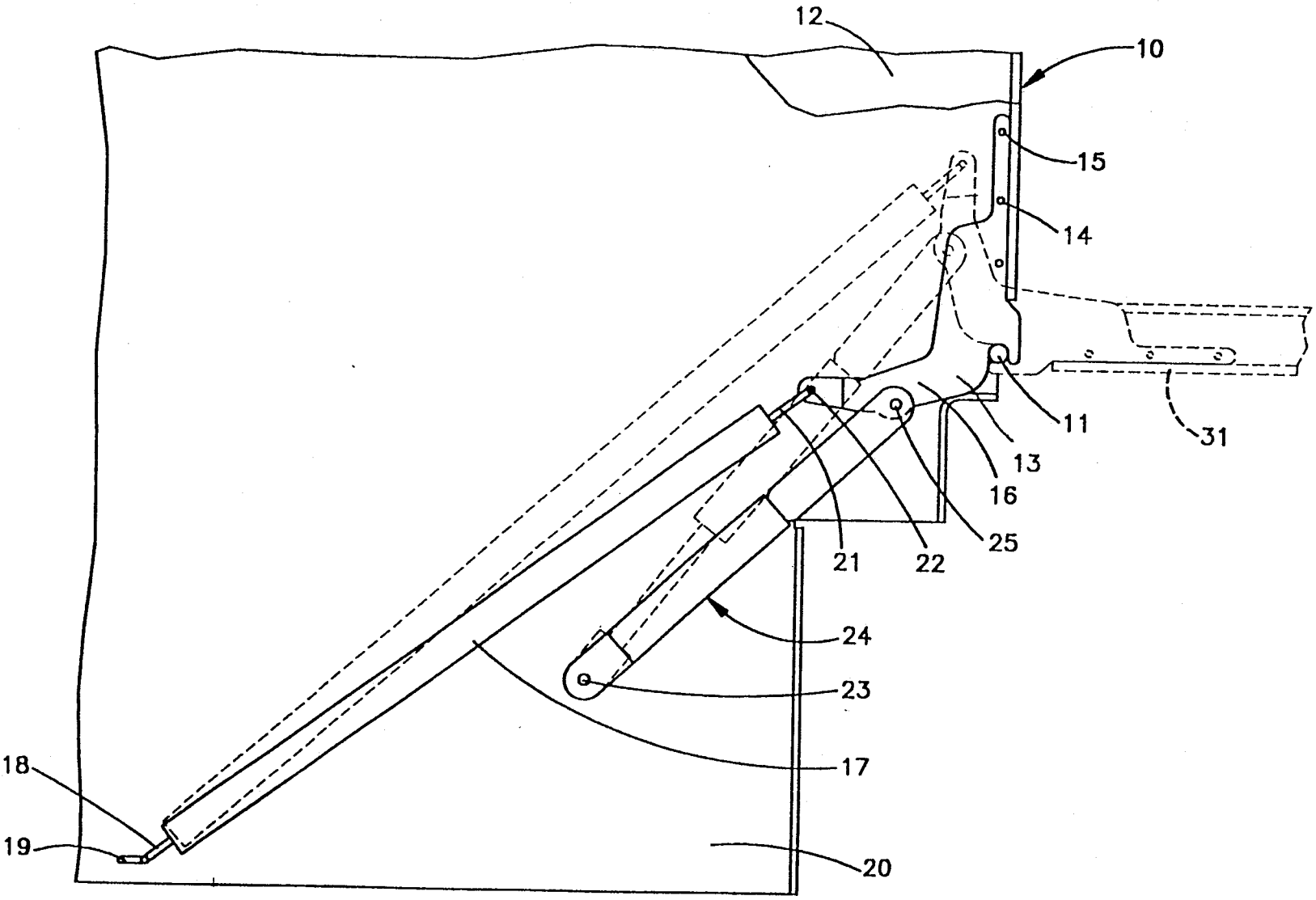
10
12
15
14
31
11
13
16
25
22
21
24
23
17
20
18
19

DISHWASHER DOOR CONTROL SYSTEM

This is a continuation of application Ser. No. 07/750,096, filed Aug. 26, 1991, now abandoned.

BACKGROUND OF INVENTION

This invention relates generally to dishwashers and more particularly to a novel and improved control system for controlling the operation of a dishwasher door as it moves between the closed vertical position and the fully opened, generally horizontal position.

SUMMARY OF INVENTION

Typically, dishwashers provide a door mounted for pivotal movement about a generally horizontal pivot axis between a substantially vertical closed position and a substantially horizontal, fully opened position. It is also typical in such dishwashers to provide a spring system to counterbalance the door as it moves to the fully open position. Such spring systems are designed to allow the door to remain in the open position and to move between the opened and closed position with little or no effort.

In recent years, there has been a trend to provide dishwashers having doors on which decorative panels of different types of wood or plastic are mounted on the exterior surface of the door so as to blend in with the remaining cabinet structure. Since such panels are mounted on the door at the time of installation and since the weight of such panels vary within wide limits, different types of mechanical adjusting means have been provided for the springs to properly counterbalance the door with a particular panel mounted thereon. The simplest versions of these arrangements have included different fastening points for one or both ends of the spring. The European patent EP 386.725 and the German patent DE 3.140.039 disclose more elaborate systems for adjusting the counterbalancing system. These adjusting systems are more complicated but easier to adjust. Nevertheless, for all of these arrangements the installer has to carry out tests to find the best position when the panel is mounted on the door and such tests are time consuming and troublesome.

SUMMARY OF INVENTION

The present invention provides a simple counterbalancing system for dishwasher doors which functions satisfactorily when the door weight varies through relatively wide limits and without any adjustments. Therefore with the present invention, a variety of decorative panels having different weights can be installed on the outer surface of a dishwasher door without adversely affecting the operation of the counterbalancing system.

In the illustrated embodiment, the counterbalancing system includes springs to counterbalance the weight of the door as it moves between the closed vertical position and the horizontal position. Such spring system is arranged to substantially counterbalance the weight of the door itself when a decorative panel is not mounted thereon. The system also includes a damper which controls the rate of the movement of the door as it approaches the fully opened position and therefore functions to provide proper door movement control when decorative panels having a wide variety of weights are mounted on the exterior surface of the door. Such damper therefore automatically compensates for substantially different weights of decorative panels without the need of adjustment by the installer.

These and other aspects of this invention are illustrated in the accompanying drawing and are more fully described in the following specification.

BRIEF DESCRIPTION OF THE DRAWING

The single FIGURE of the accompanying drawing is a partially broken side view of the lower front part of a dishwasher incorporating a spring and damper for counter-balancing and controlling the operation of the dishwasher door.

DETAILED DESCRIPTION OF THE DRAWING

The dishwasher includes a door 10 which is mounted on a horizontal shaft 11 for pivotal movement between a closed, substantially vertical position and a generally horizontal position illustrated in phantom. In the vertical or closed position, the door closes the opening of the tub 12 in which the dishes are stored during the washing operation. The door 10 is supported by L-shaped brackets 13 on each side of the door. One leg of the brackets are fixed to the door by screws 15 or the like. The other leg 16 of the bracket is connected to the system for controlling the operation of the door. Counter-balancing is provided by a tension spring 17 having one end 18 which is bent and inserted into a slot 19 provided in the side plate 20 of the dishwasher. The other end 21 of the spring is bent and projects through a hole 22 in the leg 16.

The side plate 20 of the machine also provides a dowel 23 connecting with one end of a damper 24. The other end of the damper 24 is in a similar way supported on a dowel 25 fastened to the other leg 16 of the bracket. The damper is constructed so that when the door approaches its fully open position, the rate of movement is controlled so that the door gently reaches the fully open position. This control of the rate of movement of the door as it approaches the fully open position is controlled by the damper substantially independently of the weight of the door therefore, when relatively heavy decorative panels 31 are mounted on the door, the door still moves gently to the fully open position. The damper may be of any suitable type such as a gas damper, an oil damper or a friction damper, a friction damper being a dry friction type in which a major part of the force is created by friction between mechanical parts such as a rubber piston and a surrounding cylinder wall.

A similar situation exists when a relatively lightweight decorative panel is mounted on the door since the damper is rate-sensitive and is substantially unaffected by different door weights. The spring 17 is designed and placed so that when the door is completely open and when there is no outer load in the form of decorative panels, the door remains in its horizontal position or is subject to a small vertical upward force.

When the door of the dishwasher is moved from its closed position to a partly open position, the bracket 13 pivots in a clockwise direction about the shaft 11. As this occurs, the spring is progressively stretched and exerts progressively higher anti-clockwise direction force. During this initial part of the opening movement, the door is not influenced by the damper 24. If the door is released from its partially open position corresponding to a comparatively small opening movement, the spring 17 causes the door to return to its vertical closed position.

If the door is pivoted further it will at some angle, dependent on the weight of the door and the additional load of the panels mounted thereon, continue to move toward the fully open position as a result of gravity. As the door continues to move toward its fully open position illustrated in phantom in the figure, the damper 24 starts to operate and controls the rate of the movement so that the door gently moves to its fully open position, regardless of the variation in weight of the door resulting from the mounting thereon of decorative panels 31. It should be noted that although a separate damper 24 and spring 17 is illustrated, they can be combined in a single integrated unit should that be desired.

With this invention, a door movement control system is provided which is substantially insensitive to variations in door weight created by the mounting of decorative panels of various types on the door. Consequently, it is not necessary to adjust the door for the specific weight of the particular decorative panel mounted on the door.

Although the preferred embodiment of this invention has been shown and described, it should be understood that various modifications and rearrangements of the parts may be resorted to without departing from the scope of the invention as disclosed and claimed herein.

What is claimed is:

1. A dishwasher comprising a door mounted for pivotal movement between a substantially vertical closed position and a substantially horizontal open position, said door having a side surface, an inner surface, and an outer surface, counterbalancing means operatively connected to said side surface of said door, said counterbalancing means applying a force to said side surface which urges said door toward said closed position, damper means operatively connected to said side surface, said damper means controlling the rate of pivotal movement of said door as it approaches said open position, said damper means causing said door to gently approach said open position, wherein bracket means are secured to said side surface to support said door during said pivotal movement, said bracket means being generally L-shaped and having a first leg attached to said side surface and a second leg extending therefrom, said second leg being connected to said counterbalancing means and said damping means and being adapted to transfer force from said counterbalancing means and said damping means to the side surface of said door, said counterbalancing means being designed to allow the door to remain in the open position until an upward force is exerted thereon by a user.

2. A dishwasher as set forth in claim 1, wherein external panels are mounted on said door, said damper means operating without adjustment of said counterbalancing means to cause said door to gently approach said open position regardless of door weight.

3. A dishwasher as set forth in claim 2, wherein said counterbalancing means includes a spring for applying a resilient force urging said door toward said closed position.

4. A dishwasher as set forth in claim 1, wherein said counterbalancing means is a spring connected to apply a resilient force urging said door toward said closed position.

5. A dishwasher as set forth in claim 1, wherein said damping means is a gas damper.

6. A dishwasher as set forth in claim 1, wherein said damping means is an oil damper.

7. A dishwasher as set forth in claim 1, wherein said damping means is a friction damper.

8. A dishwasher as set forth in claim 1, wherein a pivot point for the door is provided near an intersection of said first and second legs.

9. A dishwasher as set forth in claim 1, wherein the counterbalancing means is attached to the second leg adjacent a terminal end thereof.

* * * * *